United States Patent [19]

Deforeit

[11] 4,395,930

[45] Aug. 2, 1983

[54] TONE GENERATOR FOR AN ELECTRONIC MUSICAL INSTRUMENT

[75] Inventor: Christian Deforeit, Trossingen, Fed. Rep. of Germany

[73] Assignee: Matth. Hohner AG, Trossingen, Fed. Rep. of Germany

[21] Appl. No.: 342,846

[22] Filed: Jan. 26, 1982

[30] Foreign Application Priority Data

Jan. 27, 1981 [DE] Fed. Rep. of Germany ..... 3102643

[51] Int. Cl.[3] ..... G10H 7/00

[52] U.S. Cl. ..... 84/1.01; 84/1.03

[58] Field of Search ..... 84/1.01, 1.03

[56] References Cited

U.S. PATENT DOCUMENTS 4,127,048 11/1978 Schmoll ..... 84/1.03

4,217,802 8/1980 Deforeit ..... 84/1.01

*Primary Examiner*—Stanley J. Witkowski

[57] ABSTRACT

Polyphonic sound may be produced through the use of a tone generator which divides the high frequency output of a clock pulse generator by numbers which are allocated to individual keys or pedals of an instrument. The divisor values are stored in main and intermediate memories, the values in the intermediate memory subsequently being counted down to zero. An output signal, for control of a sweep voltage generator, is produced which is a function of all of the divisor values in the intermediate memory at any one time.

8 Claims, 2 Drawing Figures

TONE GENERATOR FOR AN ELECTRONIC MUSICAL INSTRUMENT

BACKGROUND OF THE INVENTION (1) Field of the Invention

The present invention relate to the generation of audible tones and particularly to the electronic synthesis of polyphonic music. More specifically, this invention is directed to tone generators for producing an output signal which, when applied as the control input to a sweep voltage generation circuit, will result in a signal in the audible range which varies in a polyphonic manner. Accordingly, the general objects of the present invention are to provide novel and improved methods and apparatus of such character.

(2) Description of the Prior Art

A tone generator for use in the generation of audio frequency signals in response to the operation of a pedal on an electronic organ is disclosed in U.S. Pat. No. 4,127,048. In the tone generator of the referenced patent a binary number is allocated to each pedal key. These binary numbers are stored in a memory which will function as a down counter. Upon operation of a pedal, the memory is counted downwardly by the output of a clock pulse generator and the carry pulses are used as the output of the tone generator. Thus, the binary number associated with each pedal key serves as a divisor. Submultiples of the output frequency may be derived from the carry pulses by division. While U.S. Pat. No. 4,127,048 does not so state, it is believed that the design and operation of the down counter which functions as the memory therein is in accordance with the teachings of the publication entitled "Frequency synthesizers- 2" which begins at page 75 of WIRELESS WORLD, October 1978.

The state-of-the-art as represented by U.S. Pat. No. 4,127,048 assumes that the player will actuate only a single key. Thus, in actual practice, preference or auctioneering circuits will typically be provided to prevent interferences should a plurality of keys be simultaneously actuated. Circuits such as that described in U.S. Pat. No. 4,127,048 thus do not permit the generation of polyphonic sound.

It is to be noted that digital tone generators are known in the art which permit polyphony. An example of such a digital tone generator may be seen from U.S. Pat. No. 4,217,802. The circuit of U.S. Pat. No. 4,217,802 has the capability of virtually unlimited polyphony because an individual data storage means is provided for each recognizable frequency of the chromatic scale. These plural data storage means are read sequentially in time multiplex. Thus, the generated audio signal may contain information relating to all tones which may be played on the instrument. A major drawback of a digital tone generator of the type of U.S. Pat. No. 4,217,802 is that it is comparatively complex and thus relatively expensive.

SUMMARY OF THE INVENTION

The present invention overcomes the above-discussed and other deficiencies and disadvantages of the prior art by providing an uncomplicated and thus inexpensive tone generator for use in the production of polyphonic music.

In accordance with the present invention, the note the player desires to sound will be selected by actuation of either a manual key or a pedal key. The actuation of a key will result in the generation of a numerically coded signal, preferably in digital format, commensurate with the frequency of the selected note. A preselected clock frequency will be divided by the numerical value allocated to the actuated key to produce a signal at the desired sound frequency. Thus, the selected numerical value functions as a divisor which is a multiple of the period of the note to be played, the multiplication factor being the same for all notes, i.e., being the period of the clock frequency.

In order to produce the desired sound, the numerical divisor is stored in a memory which functions as a counter to be emptied or cleared by pulses at a clock frequency. Upon reaching zero count, the memory will again be loaded with the divisor value and this procedure will continue repetitively for as long as the player commands the selected note to be produced. If another key is actuated, the divisor value allocated thereto will also be loaded into the memory. Each time zero count occurs, or when the memory is again loaded with any divisor value, an output signal in the audible frequency range is generated. This output signal will preferably be employed to trigger a sweep voltage generator and the sawtooth voltage produced thereby will be treated or processed in the usual manner by means of filters, voltage controlled amplifiers, etc. The use of sawtooth voltage generators for this purpose is well known in the art and described in various publications.

In order to cause the above-described tone generator to operate in a polyphonic manner, the memory will be comprised of a plurality of storage units, hereinafter referred to as memory locations, which are counted downwardly in multiplex modus. A limited number of divisor values, entered by actuation of a key, are stored in an intermediate memory which is addressed by a cyclically operating counter in parallel with the memory which is functioning as a down counter. This addressing is accomplished via a multiplexer which is triggered by the clock pulse generator.

In the case of an instrument which is to be utilized by a beginner, or for a toy, a polyphony of six or less notes will ordinarily be adequate. In such case the necessarily resulting frequency deviations from the tempered chromatic scale will be tolerable if a clock frequency of 20 KHz. is used to address eight bit memories. Under these conditions the tone generator will be uncomplicated and inexpensive and, in fact, may be integrated on a single chip.

BRIEF DESCRIPTION OF THE DRAWING

The present invention may be better understood and its numerous objects and advantages will become apparent to those skilled in the art by reference to the accompanying drawing in which.

DESCRIPTION OF THE PREFERRED EMBODIMENT

Figure 1:
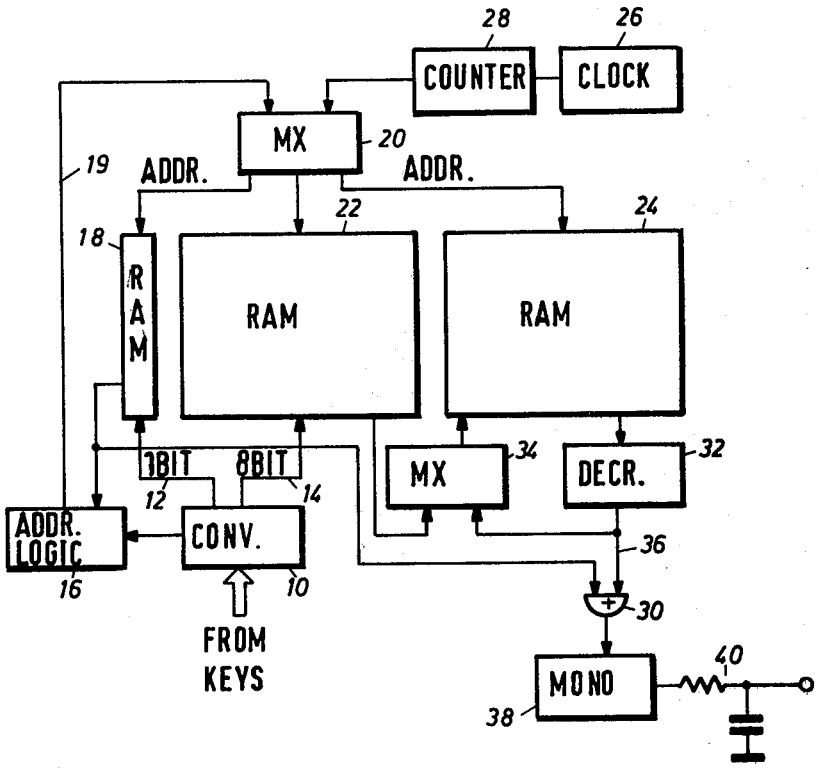
FIG. 1 is a circuit block diagram of a tone generator in accordance with the preferred embodiment of the invention.

With reference to the drawing, a scanning and encoding circuit 10, in the manner known in the art, detects the operation of keys and tabs of an associated electronic musical instrument. The results of such scanning are outputted from circuit 10 on busses 12 and 14. A logic level characteristic of actuation or nonactuation of the individual keys will appear on bus 12 and it may, for purposes of explanation, be assumed that a "high" level on bus 12 indicates key actuation. The information appearing on bus 14 will be the numerically coded data word which is commensurate with the selected sound. As will be understood by those skilled in the art, this information may vary in time in order, for example, to produce a vibrato effect.

The data words, i.e., the frequency information, on bus 14 may be eight bit words whereby, in decimal code, a maximum of 255 separate words may be presented. The tone generator will include a clock which provides pulses at a repetition rate of, for example, 20 Khz and thus at a clock period of 50 us. In the example being described the period of the lowest note will be 12.75 ms which corresponds to a frequency of approximately 78 Hz. Thus, to summarize, the numerical values of the data words appearing on bus 14 are the divisors by which a clock frequency must be divided in order to obtain a desired sound frequency.

Presuming, again for purposes of explanation, that the instrument has a frequency range of three and one half octaves, the highest note to be generated will be 500 Hz and the clock frequency will, as noted, be 20 Khz. In this case the divisor will be 40. This is thus the lowest existing numerical value commensurate with the frequency information to be encoded and is the value allocated to the highest note to be sounded. It will be understood that the numerical values discussed above are exemplary only and the instrument keyboard will have the usual chromatic design with the known frequencies. The tone generator of the present invention must try to implement these known frequencies taking into account the fact that both the clock frequency and the divisor number are necessarily entities. The resulting inherent deviations from a perfect chromatic scale may be calculated and may be tolerated.

Returning again to a consideration of FIG. 1, the data words commensurate with the frequency information are produced in scanning and encoding circuit 10 by means of code conversion with the data being read from a read-only memory and presented on bus 14 in binary format.

For purposes of explanation of the invention it may be assumed that a polyphony of N different notes is to be provided. For example, in the case of a simple instrument N may equal 6. Practice of the invention involves the intermediate storing of N frequency information containing words. It is to be noted that, should the player inadvertently actuate a seventh or, in general, an N+1th key, the tone generator may be made to ignore the additional input by means of circuitry well known in the art. Alternatively, the tone generator may be configured such that the N+1th note will automatically replace the information first written into the memory. In accorance with the invention a logic circuit 16 provides for the transfer of N frequency information containing words to the circuitry to be described below. The clearing of any memory storage location will be signalled back to logic circuit 16.

The polyphonic circuit of the present invention comprises three random access memories 18, 22 and 24. Each of these memories will have N storage or memory locations. Memory 18 stores the information, i.e., the logic level, which appears on bus 12. The addressing of memory 18 for write-in is under the control of logic circuit 16 via a multiplexer 20. The memory location in RAM 22 which has the same address as the memory location in RAM 18 in which a "high" logic level has been stored is loaded with the eight-bit frequency information data word simultaneously appearing on bus 14. There are two modes of amending the contents of the third RAM 24. In a first mode the data word held under the same address in RAM 22 may be shifted into RAM 24. In the second mode the number stored in RAM 24 may be decremented, i.e., one will be subtracted from the number and the number will then immediately be recirculated and written into RAM 24 under the same address.

The reading of the three memories is under the control of a clock pulse generator 26 which produces cycle start pulses for a counter 28 which has a count capacity of N. Counter 28 addresses, via multiplexer 20 in a second time slot of the multiplexer, the N memory locations once during each clock period of generator 26. Upon each addressing by counter 28 the contents of the respective memory locations in RAM 18 are applied as a first input to an AND gate 30. Thus, gate 30 will be enabled only if the logic level of the respective memory location is "high" thereby indicating that the key, for which the data word has been stored in memory 22, is still actuated. It is to be noted that there is no fixed correlation between individual keys and the memory locations in the three RAM's. However, data will be loaded into the memory locations in the sequence of its becoming available with the identification of the respective keys being stored in RAM 22.

Memories 18 and 24 are read simultaneously. The contents of the memory locations in RAM 24 are decremented by one at the pulse repetition frequency of counter 28. For this purpose, a decrementing circuit 32 is employed. Decrementing circuit 32 reduces the number transferred to it from memory 24 by one and then writes the decremented number into the same memory location. The reading of the decremented number into the proper memory location is insured by a multiplexer 34. Decrementing circuit 32 thus causes memory 24 to act like a down counter for each memory location until the contents of the location is zero. When this happens the decrementing circuit 32 supplies, to the second input to AND gate 30, a "high" level logic signal. This "high" level logic signal is also employed as a control signal to multiplexer 34 and results in the contents of the memory location at that instant present in RAM 22 being shifted into RAM 24. If the previously actuated key is still in the depressed state, the information stored in RAM 22 will not have changed and RAM 24 will once again be counted down to zero. If, on the other hand, the previously actuated key has been released and another key actuated, the appropriate "updated" numerical value will have been loaded into the respective memory location of RAM 22 and this new numerical value will be shifted into RAM 24.

The longest time interval required to clear a memory location in RAM 24 is equal to the maximum capacity of a memory location multiplied by the period of the clock pulse generator 26. In the example being given, there are 255 eight-bit memory locations and the period of the generator 26 is 50 us. Accordingly, the resulting product is 12.75 ms. This is the maximum delay for the lowest note to be played and is acceptable.

The logic signal on the output conductor 36 of decrementing circuit 32 is, as noted, applied to the second input of AND gate 30 causing the gate to provide, at its output, a "high" level each time a number is written into RAM 24. The output of gate 30 is employed to gate a monostable multivibrator 38. The output of multivibrator 38 is delivered to a conventional sweep voltage generator which, in the example being described, comprises an RC circuit 40 which produces a sawtooth voltage waveform. The sawtooth voltages produced during the sequential reading of RAM 24 are superimposed upon each other to thereby produce an analog signal which may, after appropriate processing, be used to drive a loudspeaker. This processing may include filtering, application to voltage controlled amplifiers, etc.

In the example being described, there are 255 data words which may be loaded into memory 24. In the case where the eight-bit word is all "ones", i.e., the number of the word is 255, multivibrator 38 will be triggered at a repetition rate of approximately 78 cps, i.e., with a signal having a period of 12.75 ms. If another memory location in memory 24 contains the binary equivalent of the number 87, the multivibrator 38 will be triggered each 87 times 50 us, i.e., each 4.35 ms thus resulting in a repetition frequency of approximately 230 cps.

Figure 2:
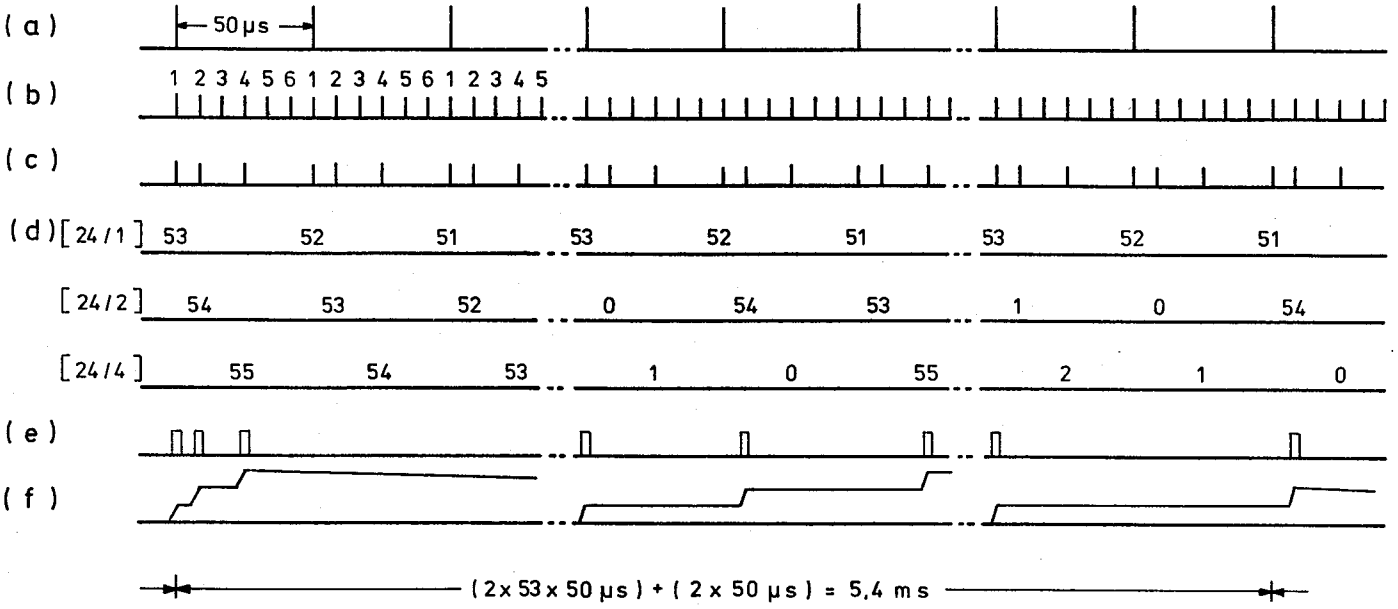
FIG. 2 is a timing diagram which will facilitate understanding of the operation of the circuit of FIG. 1.

To illustrate the behavior of the circuit, FIG. 2 comprises a timing diagram wherein it is assumed that three memory locations 24/1, 24/2 and 24/4 of memory 24 are respectively loaded with the frequency information binary words "53", "54" and "55". The diagram shows three successive intervals in which the multivibrator 38 is triggered. For purposes of explanation, the time scale has been interrupted between these three intervals because, for purposes of consideration of the present invention, no events of interest will take place in the intervals.

Continuing to refer to FIG. 2, the output pulses provided by the clock generator 26 are indicated at (a). The addressing signals provided by counter 28 in response to the clock pulses are indicated at (b). The information which will be read from memory 18, indicative of a "high" logic level on bus 12 commensurate with instrument key actuation, is indicated at (c). The signal (c) is the enabling signal for AND gate 30. The "counts" which are in the memory locations 24/1, 24/2 and 24/4 are indicated at (d). The output of multivibrator 38 is indicated at (e) and the voltage provided by sweep voltage generator 40 in response to the output of multivibrator 38 is indicated at (f). It will be observed from FIG. 2 that the time constant of the sweep voltage generator 40 must be selected such that the capacitor of the RC circuit shown will discharge within the period of the lowest audio frequency to be generated. In the example being described this frequency will be approximately 78 cps.

As noted above, the divisors stored in memory 24 are necessarily whole numbers and thus it is unavoidable that deviations from a properly tempered chromatic scale will result. For simple musical instruments, however, such deviations are acceptable.

As also mentioned above, circuits may be provided between the output of the sweep voltage generator 40 and the loudspeaker to process the sweep voltage to vary the amplitude thereof and particularly to vary the attack, the decay and envelope. The sawtooth voltage produced by the RC circuit depicted in FIG. 1 is particularly well suited for such processing and may be fed to several parallel channels in order to simulate solo, base, chorus and the like.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A tone generator for an electronic musical instrument, the instrument including a plurality of keys which may be actuated to produce input signals, said tone generator comprising:

means for scanning the keys of the instrument and for producing a numerically coded signal identifying the musical note allocated to each key which is actuated;

first memory means, said first memory means having a plurality of memory locations, said memory locations being less in number than the number of instrument keys and being equal in number to the number of notes which may be played at one time;

second memory means, said second memory means having memory locations equal in number to said first memory means;

means for loading into the memory locations of said first memory means the numerically coded signals commensurate with actuated keys;

clock pulse generator means;

counter means, said counter means being responsive to clock pulses produced by said clock pulse generator means, said counter means having a capacity equal in number to the memory locations in said memory means;

multiplexor means connected to said counter means and said second memory means for simultaneously decrementing the numerically coded signals stored in each of said second memory means memory locations;

means for transferring numerically coded signals stored in said first memory means into corresponding memory locations in said second memory means whenever the said corresponding memory location in said second memory means has been cleared by being counted down to zero;

means responsive to each clearing of a memory location in said second memory means for generating a trigger signal; and sweep voltage generator means responsive to said trigger signal for generating a polyphonic signal in the audible frequency range.

2. The tone generator of claim 1 wherein the output of said clock pulse generator means is about 20 KHz and said memory means store eight-bit coded signals at each memory location.

3. The tone generator of claim 1 wherein said trigger signal generating means comprises a monostable multivibrator and wherein said sweep voltage generator means comprises an RC circuit which generates a sawtooth waveform signal.

4. The tone generator of claim 3 further comprising enabling means for generating an enabling signal for said multivibrator upon actuation of a key.

5. The tone generator of claim 4 wherein said enabling means comprises an auxiliary memory having the same number of storage locations as said first and second memory means, said auxiliary memory receiving and holding the key actuation signals, said auxiliary memory being addressed in synchronism with said first and second memory means.

6. The tone generator of claim 5 wherein the output of said clock pulse generator means is about 20 KHz and said memory means store eight-bit coded signals at each memory location.

7. The tone generator of claim 1 further comprising enabling means for generating an enabling signal for said trigger signal generating means upon actuation of a key.

8. The tone generator of claim 7 wherein said enabling means comprises auxilliary memory means having the same number of storage locations as said first and second memory means, said auxilliary memory means receiving and holding the key actuation signals, said auxilliary memory means being addressed in synchronism with said first and second memory means.

* * * * *